US005810264A

United States Patent [19]

Yost

[11] Patent Number: 5,810,264

[45] Date of Patent: Sep. 22, 1998

[54] FUEL ATOMIZATION ASSEMBLY

[76] Inventor: Robert M. Yost, 10838 Olive St. NW., Coon Rapids, Minn. 55448

[21] Appl. No.: 732,183

[22] Filed: Oct. 16, 1996

[51] Int. Cl.[6] ..... F02M 31/00

[52] U.S. Cl. ..... 239/552; 239/553.3; 239/585.1

[58] Field of Search ..... 239/390, 392, 239/396, 533.3, 533.12, 585.1, 585.5, 600, 552, 553.3, 590.3

[56] References Cited

U.S. PATENT DOCUMENTS

| | | | |
|---|---|---|---|
| 3,007,683 | 11/1961 | McCracken . | |
| 3,961,754 | 6/1976 | Kuhns et al. | 239/396 X |
| 4,666,088 | 5/1987 | Krauss et al. | 239/585.1 X |
| 5,035,358 | 7/1991 | Katsuno et al. | 239/585.1 X |
| 5,218,943 | 6/1993 | Takeda | 239/533.12 X |
| 5,223,180 | 6/1993 | Yost . | |
| 5,284,302 | 2/1994 | Kato et al. | 239/585.1 |

FOREIGN PATENT DOCUMENTS

| | | | |
|---|---|---|---|
| 2127097 | 4/1984 | United Kingdom | 239/533.12 |
| 94/02736 | 2/1994 | WIPO | 239/533.12 |

*Primary Examiner*—Kevin Weldon
*Attorney, Agent, or Firm*—James W. Miller

[57] ABSTRACT

A fuel atomization assembly for a fuel injector includes a mounting member that slips over the end of the fuel injector having the injector nozzle. The mounting member includes a bore aligned with the fuel spray outlet in the nozzle and extending away therefrom. A fuel flow guide tube is received inside the bore, having a lesser diameter than the bore, and being perforated over a portion of its length, to better atomize the fuel stream leaving the injector nozzle. The fuel flow guide tube has an enlarged head sandwiched between the injector nozzle and the inlet to the bore in the mounting member.

10 Claims, 2 Drawing Sheets

FUEL ATOMIZATION ASSEMBLY

Technical Field

This invention relates to an assembly for supplying atomized fuel, such as gasoline, to a motor vehicle, such as a motorcycle or automobile. More particularly, this invention relates to an assembly used in conjunction with a fuel injector for supplying highly atomized fuel to an airflow passage.

Background of the Invention

Fuel discharge assemblies are known which atomize fuel in an airflow passage to better mix the fuel with the air. One such assembly is shown in the Applicant's prior U.S. Pat. No. 5,223,180. This assembly includes an internal fuel flow guide tube which is inserted inside a fuel discharge tube. The fuel flow guide tube includes a cylindrical body which is telescopically received in an internal bore of the discharge tube and extends at least part of the way up the length of the internal bore from the inlet towards the outlet.

The fuel flow guide tube of the Applicant's prior patent can be installed in a fuel discharge assembly that is separable to allow the fuel flow guide tube to be installed inside the existing fuel discharge tube. However, some fuel discharge assemblies of the fuel injector type cannot be easily taken apart to allow the fuel flow guide tube to be installed inside the injector nozzle. Accordingly, the only fuel atomization that occurs in this type of fuel discharge assembly is that provided by the nozzle itself. It is desirable that additional or more complete fuel atomization occur even when using a fuel injector type of fuel discharge assembly.

SUMMARY OF THE INVENTION

One aspect of this invention is to provide a fuel atomization assembly that may be used externally of a fuel injector nozzle to promote better fuel atomization and which is easy to install on such a nozzle.

This and other aspects of this invention are provided by a mounting member having an open end that allows the member to be press fit over the nozzle of a fuel injector and a substantially closed end that substantially covers the nozzle of the fuel injector when the mounting member is so installed. The substantially closed end of the mounting member includes a longitudinal bore that extends through the closed end with the bore having an inlet located adjacent the fuel injector nozzle and an outlet that is spaced from the fuel injector nozzle. A fuel flow guide tube is telescopically received in the bore having an enlarged head immediately adjacent the injector nozzle sandwiched between the injector nozzle and the inlet of the bore. The fuel flow guide tube is perforated over a portion of its length and is smaller than an interior diameter of the longitudinal bore to create an annular space or gap therebetween. The fuel flow guide tube extends at least part of the way up the length of the bore.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Applicant's prior U.S. Pat. 5,223,180is hereby incorporated by reference for its teachings relating to a fuel discharge assembly. The fuel flow guide tube of this invention is similar in shape and function to the fuel flow guide tube shown in the Applicant's prior patent.

Figure 1:
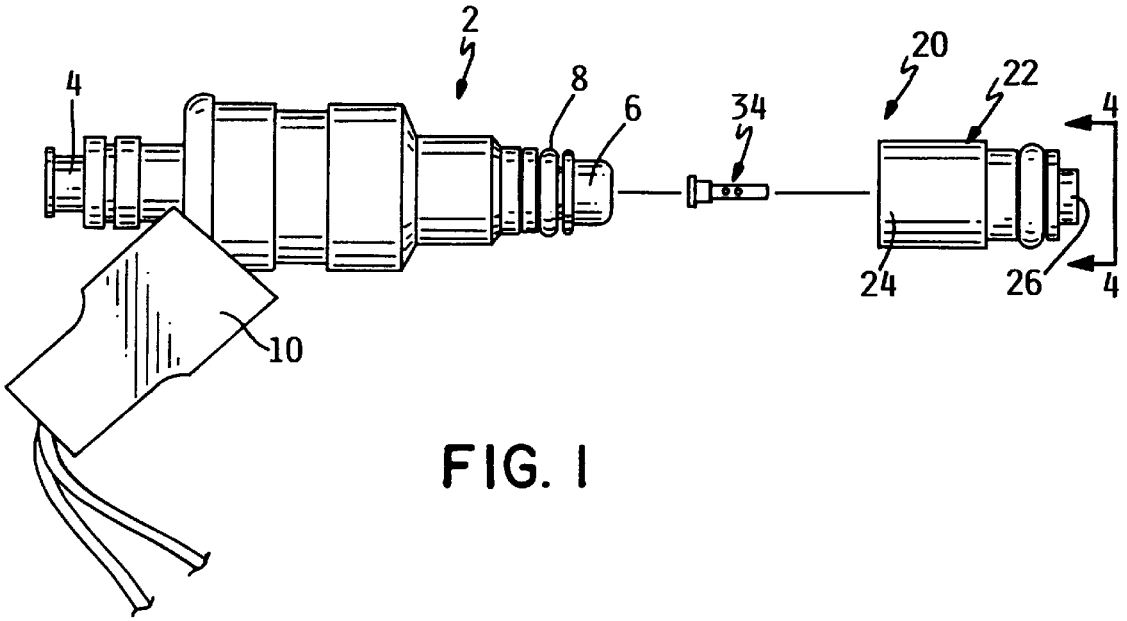
FIG. 1 is an exploded side elevational view of the improved fuel atomization assembly of this invention, showing the mounting member and fuel flow guide tube in an exploded form separated from the injector nozzle for the sake of clarity.
Figure 2:
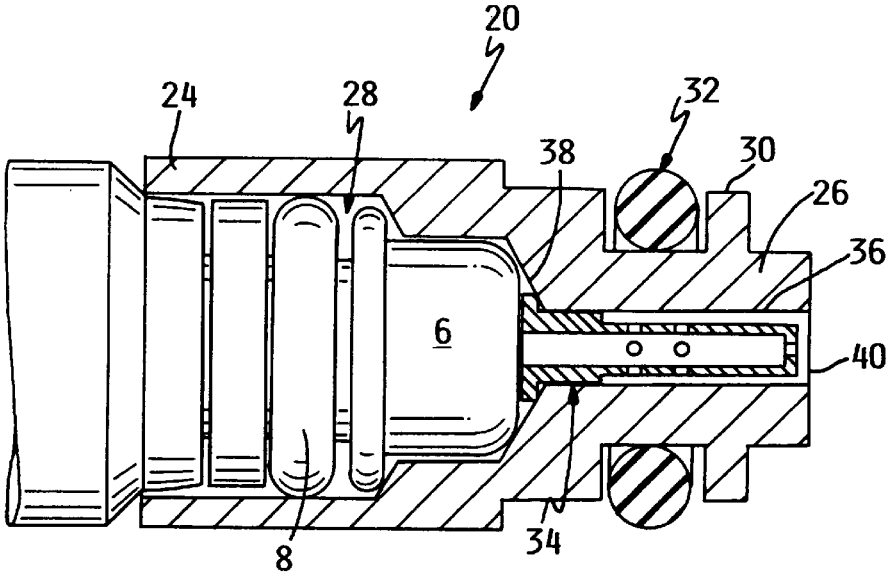
FIG. 2 is a side elevational view of the improved fuel atomization assembly of this invention, showing the mounting member and the fuel flow guide tube in cross-section installed on the injector nozzle.
Figure 3:
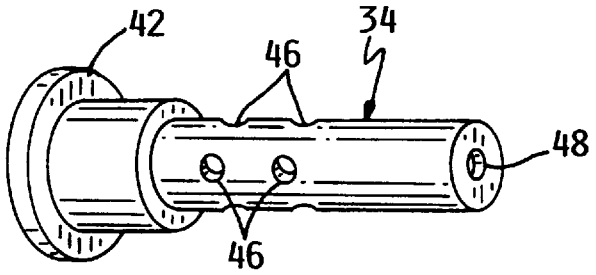
FIG. 3 is a perspective view of the fuel flow guide tube of the fuel atomization assembly as shown in FIG. 1.
Figure 4:
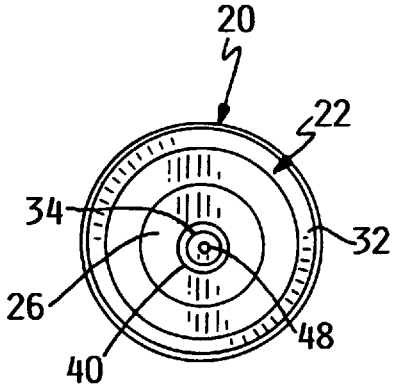
FIG. 4 is an end elevational view of the fuel atomization assembly as shown in FIG. 1 taken along lines 4—4 of FIG. 1.

Referring first to FIG. 1, an electrically operated fuel injector is shown at 2. Fuel injector 2 includes an inlet 4 to which a hose (not shown) may be attached for supplying fuel thereto and a nozzle 6 from which the fuel is typically sprayed in a spray or stream. Nozzle 6 includes a sealing 0-ring 8 adjacent thereto for sealing nozzle 6 in an airflow passage of an engine. A solenoid 10 or other electrically operated device is controlled by a control means (not shown) for allowing the fuel flow through injector 4 to be controlled. The fuel could be allowed to exit injector 4 in a continuous spray or stream, but more typically the fuel would be periodically released from injector 4 in pulses.

As described thus far, injector 4 is meant to represent any conventional fuel injector. As such, injector 4 is often purchased fully assembled in the form shown in FIG. 1. and cannot be disassembled without damaging or destroying injector 4. Accordingly, whatever fuel atomization occurs will take place by virtue of the shape of the outlet provided in nozzle 6. There has been no way to conveniently supplement this fuel atomization prior to this invention.

This invention comprises a two part fuel atomization assembly 20 that may be easily installed on fuel injector 2 to increase the fuel atomization in the fuel stream leaving injector 4. Assembly 20 includes a mounting member 22 having an open end 24 and a substantially closed end 26 such that a cup-shaped pocket 28 is formed in mounting member 22 surrounding open end 24 thereof. Pocket 28 is sized to receive nozzle 6 of fuel injector 2 therein in a tight press fit with the sealing 0-ring 8 that is provided adjacent nozzle 6 serving to seal against pocket 28 in mounting member 22. While a press fit connection between mounting member 22 and nozzle 6 of fuel injector 2 is preferred to allow member 22 to be easily and quickly installed on injector 2, other types of connections, e.g. a clamping connection, could be used.

The exterior of mounting member 22 includes a groove 30 in which a sealing 0-ring 32 is received. The portion of mounting member 22 having groove 30 steps down somewhat in size from open end 24 of mounting member 22. This allows fuel injector 2 to be installed in the airflow passage in much the same way as before with the 0-ring 32 on mounting member 22 now serving to seal injector 4 into the airflow passage. Thus, fuel injector 2 will be supported and sealed in the airflow passage as it has always been, except that now mounting member 22 performs the support and sealing function with fuel injector 2 now being carried in mounting member 22 slightly rearwardly from its normal position by virtue of having first been inserted into mounting member 22.

The primary function of mounting member 22 is to form a means for holding a fuel flow guide tube 34 immediately adjacent nozzle 6 to be able to more fully atomize the fuel exiting nozzle 6. In this regard, the substantially closed end of mounting member 22 has a longitudinal bore 36 extending therethrough from an inlet 38 to an outlet 40. Fuel flow guide tube 34 is telescopically received in bore 36 by dropping tube 34 down into bore 36 through pocket 28 formed in open end 24 of mounting member 22 until an enlarged head 42 on fuel flow guide tube 34 abuts against inlet 38 to bore 36. This insertion of fuel flow guide tube 34 is obviously done prior to installation of mounting member 22 on fuel injector 2. When mounting member 22 is so installed, enlarged head 42 of fuel flow guide tube 34 will be abutted up against the fuel flow outlet of nozzle 6, in effect being sandwiched between nozzle 6 and inlet 38 of bore 36 in mounting member 22.

Fuel flow guide tube 34 is shaped much like that in the Applicant's prior patent, being perforated over at least a portion of the length thereof and having a fuel flow passage 44 extending therethrough. The outside diameter of fuel flow guide tube 34 is slightly smaller than the inside diameter of bore 36 in mounting member 22 to form an annular gap between tube 34 and the inside diameter of bore 36. Thus, fuel flowing through fuel flow passage 44 in guide tube 34 will be able to exit through the perforations 46 in tube 34 as well as through the outlet 48 in the end of tube 34. Use of fuel flow guide tube 34 adjacent nozzle 6 better atomizes the fuel stream leaving nozzle 6 of injector 4, thus leading to improved engine performance and less pollution.

Various modifications of this invention will be apparent to those skilled in the art. Accordingly, this invention is to be limited only by the appended claims.

I claim:

1. A fuel atomization assembly for a fuel injector having an injector nozzle, which comprises:

(a) a mounting member which is received around one end of the fuel injector substantially covering the injector nozzle, wherein the mounting member includes a longitudinal bore aligned with and adjacent the injector nozzle; and (b) a hollow fuel flow guide tube carried by the mounting member and located immediately adjacent the injector nozzle such that fuel exiting the injector nozzle flows into and through the fuel flow guide tube to allow better atomization of the fuel, wherein the fuel flow guide tube is received at least partly inside the longitudinal bore of the mounting member, wherein the fuel flow guide tube has a smaller diameter than an inside diameter of the bore to form an annular space therebetween, and wherein the fuel flow guide tube has at least one hole along its length communicating with the annular space formed between the guide tube and the inside diameter of the bore to allow fuel to also flow from inside the guide tube into the annular space.

2. A fuel atomization assembly as set forth in claim 1, wherein the mounting member has a press fit to the one end of the fuel injector.

3. A fuel atomization assembly as set forth in claim 1, wherein the mounting member has an open end forming a pocket in which the one end of the fuel injector is received.

4. A fuel atomization assembly as set forth in claim 1, wherein the fuel flow guide tube has a plurality of spaced holes over its length which allow fuel to also flow from inside the guide tube into the annular space formed between the guide tube and the inside diameter of the bore.

5. A fuel atomization assembly as set forth in claim 1, wherein the fuel flow guide tube is open at both ends with one end being located closely adjacent the injector nozzle and the other end being located within the bore of the mounting member.

6. A fuel atomization assembly as set forth in claim 1, wherein one end of the fuel flow guide tube is formed as an enlarged head which is sandwiched between the injector nozzle and an inlet of the longitudinal bore when the mounting member is mounted on the fuel injector.

7. A fuel atomization assembly as set forth in claim 5, wherein the mounting member has a press fit to the one end of the fuel injector nozzle.

8. A fuel atomization assembly as set forth in claim 6, wherein the mounting member includes an exterior 0-ring for sealing the mounting member in an airflow passage.

9. A fuel atomization assembly for a fuel injector having an injector nozzle, which comprises:

(a) a mounting member having an open end that allows the member to be installed over the injector nozzle and a substantially closed end that substantially covers the injector nozzle when the mounting member is so installed, wherein the substantially closed end of the mounting member includes a longitudinal bore that extends through the closed end with the bore having an inlet located adjacent the fuel injector nozzle and an outlet that is spaced from the fuel injector nozzle; and (b) a fuel flow guide telescopically received in the bore having an enlarged head immediately adjacent the injector nozzle sandwiched between the injector nozzle and the inlet of the bore, wherein the fuel flow guide tube is perforated over a portion of its length and is smaller than an interior diameter of the longitudinal bore to create an annular space or gap therebetween, and wherein the fuel flow guide tube extends at least part of the way up the length of the bore.

10. A fuel atomization assembly as set forth in claim 9, wherein the mounting member has a press fit over the injector nozzle.

* * * * *